United States Patent [19]

Nash

[11] Patent Number: 4,640,192

[45] Date of Patent: Feb. 3, 1987

[54] MEANS FOR SECURING TUBES TO A TUBE SHEET

[76] Inventor: Henry G. Nash, 3924 S. Jamestown, Tulsa, Okla. 74135

[21] Appl. No.: 799,437

[22] Filed: Nov. 19, 1985

[51] Int. Cl.[4] ..... F42B 1/02

[52] U.S. Cl. ..... 102/307; 102/323; 102/332; 89/1.14; 228/2.5

[58] Field of Search ..... 102/312, 313, 323, 332, 102/307; 89/1.14, 228/2.5

[56] References Cited

U.S. PATENT DOCUMENTS

| | | | |
|---|---|---|---|
| 3,411,687 | 11/1968 | Riley et al. | 228/2.5 |
| 3,491,798 | 1/1970 | Beshara | 228/2.5 X |
| 3,562,887 | 2/1971 | Schroeder et al. | 228/2.5 |
| 3,993,001 | 11/1976 | Hawes | 89/1.14 |
| 4,061,261 | 12/1977 | Fredriksson et al. | 89/1.14 X |
| 4,513,903 | 4/1985 | Feldstein et al. | 228/2.5 X |
| 4,583,672 | 4/1986 | Bibb et al. | 228/2.5 |

*Primary Examiner*—Peter A. Nelson

*Attorney, Agent, or Firm*—Head, Johnson & Stevenson

[57] ABSTRACT

A device for mechanically welding a tube to a tube sheet having holes into which the tube is placed. A detonator is provided for detonating explosives for generating gas at a high pressure. A barrel having a perforated section is attached to the detonator for receiving the generated gas. An external disc-shaped stop surrounds the barrel for contacting an area of the tube sheet surrounding the hole. A disc-shaped internal stop is positioned on the barrel at the end of the perforated section opposite the external stop so that gas is mostly confined inside the tube between the external and internal stops.

4 Claims, 6 Drawing Figures

MEANS FOR SECURING TUBES TO A TUBE SHEET

BACKGROUND OF THE INVENTION

This invention relates generally to explosive welding or mechanical type welding for securing tubes to a tube sheet such as in heat exchangers.

There are various explosive welding techniques described in literature such as in U.S. Pat. Nos. 3,411,687; 4,030,419 and 3,662,452. Most tubes are expanded in the holes in the tube sheet by non-explosive mechanical expanders. However, considerable time and therefore money can be saved if a reliable simple reusuable explosive type device were available and used. Accordingly, it is an object of this invention to provide a manually held mechanical welding tool which is operated by gas generated from an explosive mixture.

SUMMARY OF THE INVENTION

In conventional heat exchangers, there are two spaced apart tube sheets with a plurality of holes therein. Tubes are placed in corresponding holes in each of the tube sheets, thus providing a plurality of parallel tubings or tubes held between the two tube sheets. My invention concerns the securing of the ends of these tubes to the holes in the tube sheets to form a sealing relationship therewith. I disclose a device for mechanically welding each tube to a tube sheet having holes therein to which the tube is placed which includes a detonator for detinating an explosive for generating gas at high pressure. A barrel having a perforated section is attached to said detonator for receiving the generated gas. There are two stops surrounding the barrel so that the high pressure gas will be largely confined in the tubing within the boundaries of the tube sheet at the hole. This includes an external disc shaped stop surrounding the barrel for contacting an area of said tube sheet surrounding the hole. A disc shaped internal stop is on the barrel at the end of the perforated section opposite the external stop and is positioned at a location corresponding to the inside of the tube sheet.

After the tube is inserted into its selected hole in the tube sheet, I insert the internal stop and perforated section of the barrel into the tubing until the external disc shaped stop is adjacent the external wall of the tube sheet. I then detinate the explosive and generate gas at high pressure which is directed out through the perforated section and causes the tubing to rapidly expand against the hole into which it has been set. My device is reusable.

I also provide means for adjusting the position of the internal stop to provide or different thicknesses of tube sheets.

DETAILED DESCRIPTION OF THE PREFERRED EMBODIMENT

Figure 1:
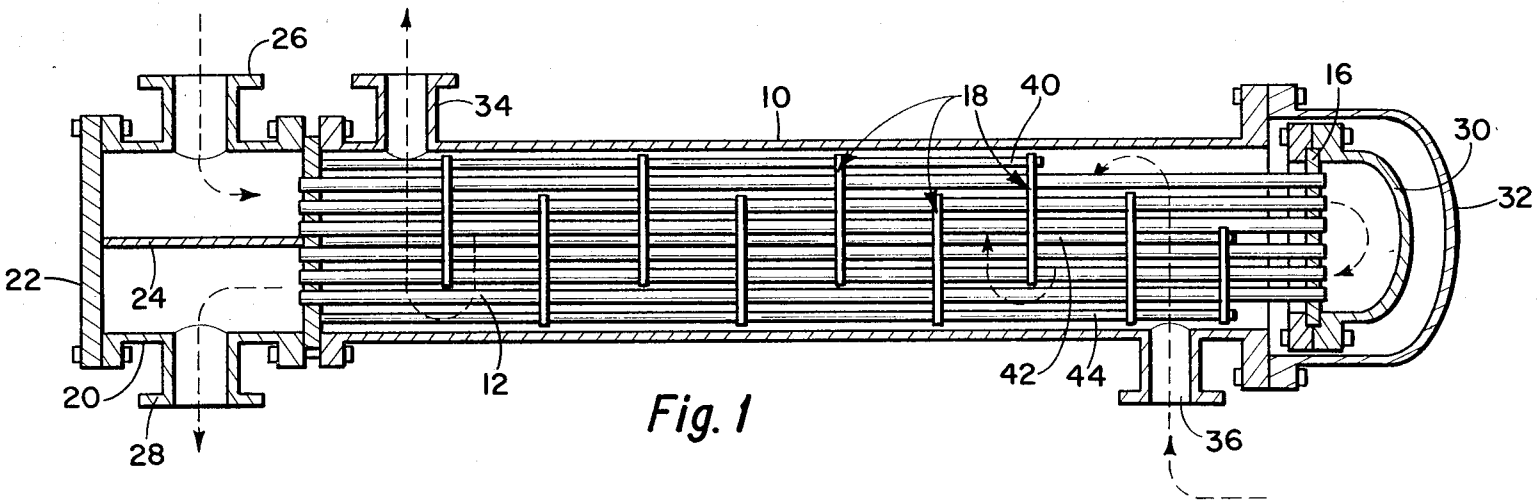
FIG. 1 shows a conventional floating head shell and tube heat exchanger.

Attention is first directed to FIG. 1 which shows a conventional heat exchanger. This particular heat exchanger is called a floating head shell and tube exchanger. It includes a shell 10 which is normally a cylinder and has a plurality of tubular members 12 placed in holes in tube sheet 14 and parallel tube sheet 16 which, in this case, is a floating tube sheet. Baffles 18 are provided for directing the flow path of fluid through the heat exchanger. An end cylinder 20 having end flange 22 is secured to shell 10 and holds tube sheet 14 in place. The cylinder 20 is provided with a partition 24 which divides the cylinder 22 into two parts. The first part has an inlet 26 and the second part has a fluid flow outlet port 28. The floating tube sheet 16 is connected to a small bell 30 which more or less floats inside a large bell 32 which is connected to the end of shell 10. Shell 10 has a fluid flow out port means 34 and a fluid flow in port 36. Rods 40, 42 and 44 are provided for positioning and securing the baffles 18. The operation and features of heat exchangers such as shown in FIG. 1 are well known and the details thereof will not be gone into.

Figure 2:
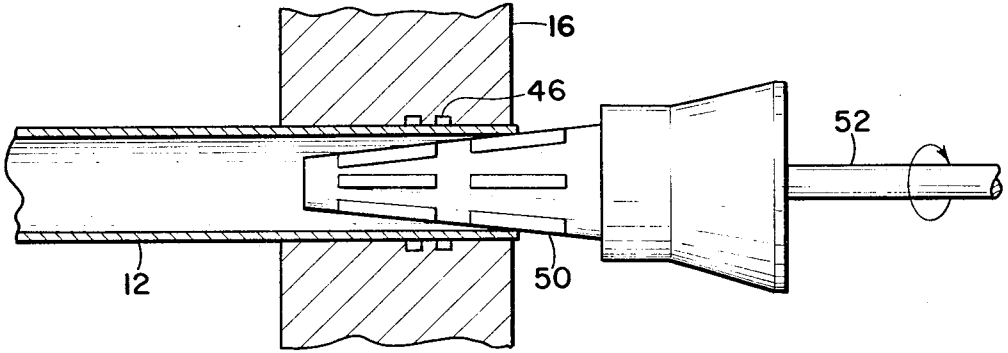
FIG. 2 shows a conventional method of expanding the metal tube into the tube sheet.

Attention is next directed to FIG. 2 which shows the most widely known way of securing the end of the tube 12 to the hole within tube sheet 16. Before the tube 12 is inserted therein, two or more circular grooves 46 are provided in the hole of the tube sheet. Once the tube 12 is inserted therein, then there is used a mechanical expander. A typical mechanical expanders is illustrated in FIG. 2. Shown therein is a paper extractor 50 which has a shaft 52 which can be rotated by a hand drill or any other convenient method. This method is fairly effective, but it is too time consuming. For example, the time required to expand one end of a tube is between 5 to 7 minutes and averages about 6 for the normal size tubing.

Figure 3:
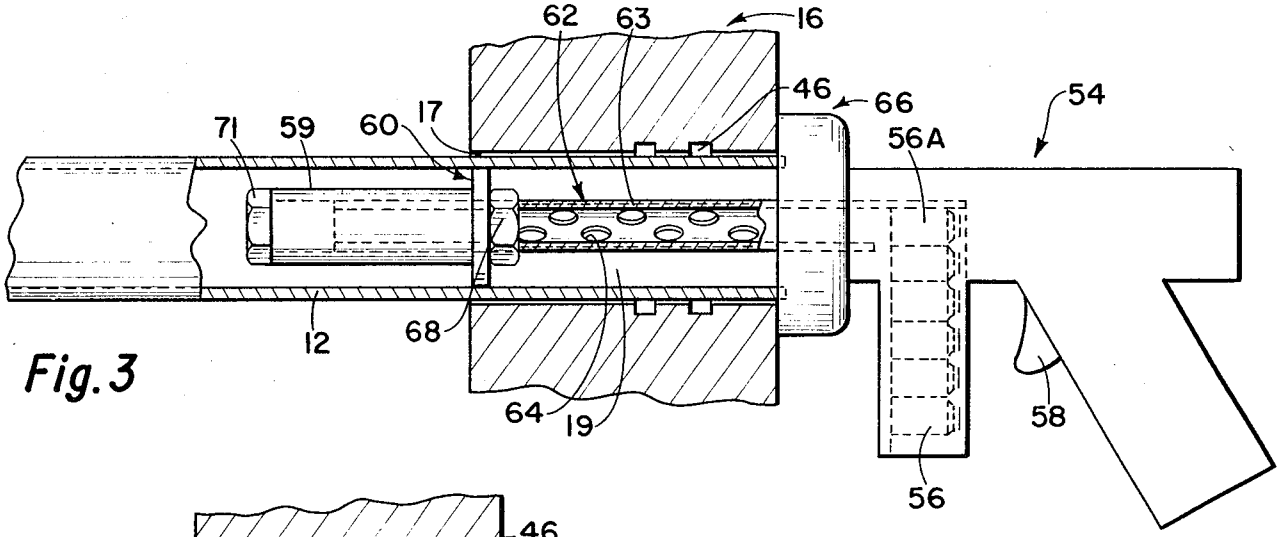
FIG. 3 is a view partially in section showing my invention for expanding a tube in a hole against the tube sheet.
Figure 6:
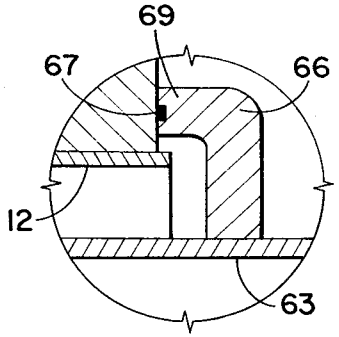
FIG. 6 shows, partly in section, a portion of the external seal.
Figure 4:
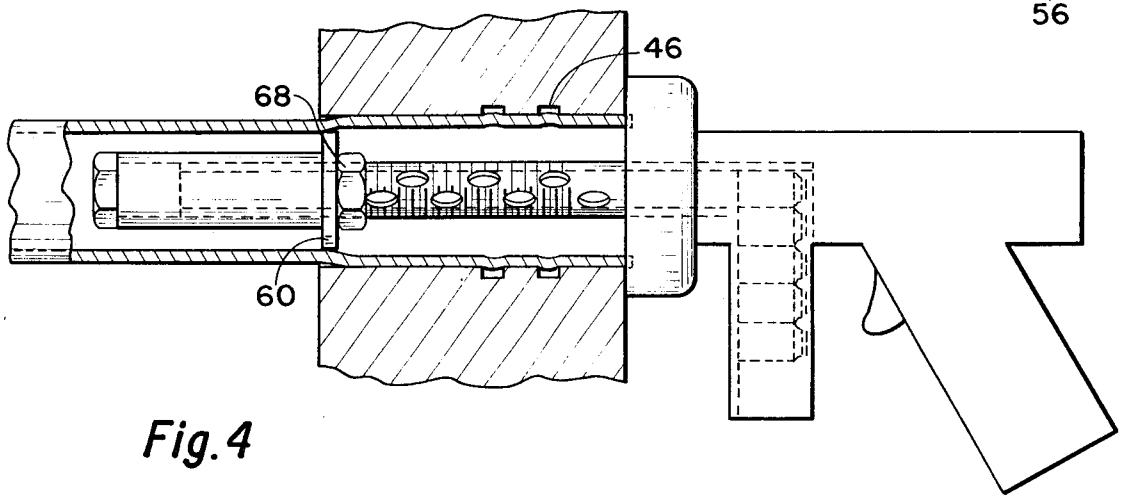
FIG. 4 is similar to FIG. 3 except it shows the tube expanded against the tube sheet after operation of my device.
Figure 5:
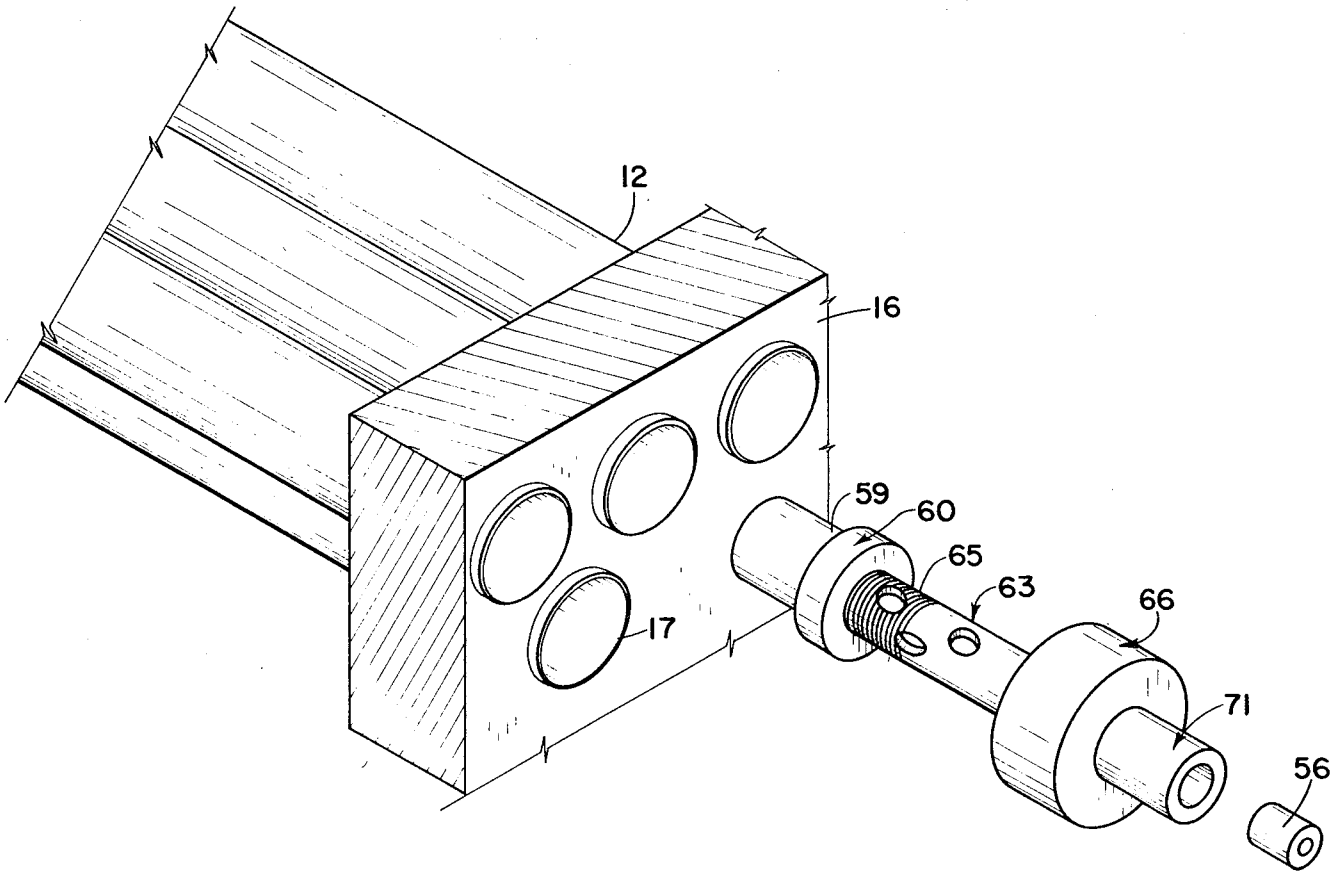
FIG. 5 shows a perspective view of my difuser.

Attention is next directed to FIGS. 3 and 4 which shows my invention in use for mechanically bonding a tube to a tube sheet. Shown therein is a detonator 54 having cartridges 56 and a trigger 58. These cartridges can be blanks and the detonator can be any typical detonator or gun which can detinate the cartridge 56 upon squeezing the trigger 58. Detonator 54 is provided with a gas diffuser 62 which includes a perforated section 63 which is connected to the output of detonator 54 to receive the high pressure gas therefrom. Means are also provided to confine the high pressure gas largely to the interior of tubing 12 within the limits of the thickness of the tubing sheet 16. This includes an external stop 66 and an internal stop 60 both secured to the barrel which includes the perforated sections 63. Exterior stop 66 is fitted with a seal 67 as shown in FIG. 6. This can conveniently be an O-ring seal and it is seen that it is in a lip 69 of the exterior stop 66 and contacts the sheet tube 16 around the opening of the hole 17 in which tubing 12 is inserted. The other end of the space within the tube 12 is sealed by internal stop 60 which fits rather tightly within tubing 12. As shown in FIG. 5, internal stop 60 is provided with internal threads for mating with threads 65 on diffuser or perforated section 63. The internal stop can be adjusted to the correct position and then nut 68 shown in FIGS. 3 and 4 would be screwed down to lock the internal stop 60 in position. The nut is not shown in FIG. 5 so that the rest of the mechanism can be clearly seen. The end of cylinder 59 which is a part of stop 60 can be provided with a nut 68 if desired to facilitate the positioning of stop 60 on thread 65. As shown in FIG. 5, the external stop 66 is provided with a cartridge receiver 71 so that cartridge 56 can be at least partially inserted therein so that when cartridge 56 is detinated the gas will all rush inwardly through the difuser and out the perforations of the perforated section 63.

FIG. 3 shows the gun and cartridge 56, before detonation, in position to perform the mechanical bonding of the tubing 12 to the side of hole 17 in tube sheet 16. By holding the gun such that the exterior stop 66 is held firmly against the tube sheet 16 and then detonating the cartridge 56A, high pressure gas will rush through perforated section and be largely confined in space 19 within tube 12 between exterior stop 66 and interior stop 60. The velocity and pressure of this high pressure gas quickly expands the tubing 12 outwardly against the walls of the hole 17 so that it essentially takes the shape of that shown in FIG. 4. As can also be seen, the tubing is partially expanded into grooves 46 cut in the wall of hole 17 to give added strength to the joint. Once this is accomplished, I then quickly remove the device from tubing 12 as shown in FIG. 4 and I am then ready to position it into another tubing which is in the tube sheet and detinate another cartridge 56 to repeat the bonding operation just described above in regard to FIGS. 3 and 4. I performed an experiment using the concept of this invention with a slightly different mechanical configuration but using essentially the same diffusion and got excellent bonding results and concluded that it can be done in approximately 30 seconds. The old mechanical expander requires on the average of about 6 minutes. The time saving is thus seen to be very great.

While this invention has been described with a certain degree of particularity, it is manifest than many changes may be made in the details of construction and the arrangement of components without departing from the spirit and scope of the disclosure. It is understood that the invention is not limited to the embodiment set forth herein for purposes of exemplification, but is limited only by the scope of the attached claim or claims, including the full range of equivalency to which each element thereof is entitled.

What is claimed is:

1. A reusable device for fastening a tube to a tube sheet having holes into which the tube is placed which comprises:
   - a detonator for detonating an explosive for generating gas at high pressure;
   - a barrel insertable into said holes and having a perforated section attached to said detonator for receiving said gas, said detonator being exterior of said barrel;
   - an exterior disc-shaped stop surrounding said barrel for contacting an area of said tube sheet surrounding a hole;
   - a reusable disc-shaped interior stop on said barrel at the end of said perforated section opposite the exterior stop and being of about the interior diameter of said tube.

2. A device as defined in claim 1 including internal stop adjustment means for adjusting the position of the internal stop along said barrel.

3. A device as defined in claim 2 in which said stop adjusting means includes internal threads on said internal stop and external threads on said perforated section.

4. A reusable device for fastening a tube to a tube sheet having holes in which the tube is placed which comprises:
   - a detonator having a gas outlet;
   - an exterior stop for surrounding said hole;
   - a non-resilient, reusable internal stop of the size to fit in said tube;
   - means to hold said internal stop at a selected distance from said external stop during operations of said detonator; and
   - means to conduct gas from said gas outlet to space between said exterior and said internal stop.

* * * * *